United States Patent [19]

Michel

[11] 4,210,007

[45] Jul. 1, 1980

[54] BENDING MACHINE

[75] Inventor: Alain J. Michel, Tassin la Demi Lune, France

[73] Assignee: Picot S.A., Tassin la Demi Lune, France

[21] Appl. No.: 954,599

[22] Filed: Oct. 25, 1978

[30] Foreign Application Priority Data

Oct. 28, 1977 [FR] France ..... 77 33340

[51] Int. Cl.[2] ..... B21D 11/04

[52] U.S. Cl. ..... 72/8; 72/319

[58] Field of Search ..... 72/7, 8, 10, 11, 21, 72/22, 310, 319, 320, 321, 322, 388, 219

[56] References Cited

U.S. PATENT DOCUMENTS

| | | | |
|---|---|---|---|
| 2,438,319 | 3/1948 | Kilham | 72/319 |
| 2,915,106 | 12/1959 | Green | 72/321 |
| 3,188,848 | 6/1965 | Barrett | 72/320 |
| 3,914,974 | 10/1975 | DeVore | 72/319 |

FOREIGN PATENT DOCUMENTS

| | | | |
|---|---|---|---|
| 2610774 | 9/1977 | Fed. Rep. of Germany | 72/319 |
| 2630896 | 1/1978 | Fed. Rep. of Germany | 72/321 |

*Primary Examiner*—Milton S. Mehr
*Attorney, Agent, or Firm*—Browdy and Neimark

[57] ABSTRACT

A bending machine for imparting bends to metal plates and the like, also called a brake, and provided with a plate holding table and a plate clamping mechanism. The plate is bent by contact with a pivoting apron. In order to provide automatic adjustment of the distance between the front edge of the bending apron and the metal plate to be bent, i.e., to provide a variable radius of curvature during the bending operation, the bending apron is mounted in slides on its pivotal support arms. The motion of the bending apron in its slides is provided by mechanical lead screws or by hydraulic jacks. In one embodiment, the distance of the front edge of the bending apron from the metal plate is controlled so as to balance the torque provided by an electric torque motor and the counter-torque offered by the plate being bent. In another embodiment, the linear motions of the bending apron are controlled to follow a template whose contour defines the desired radius of curvature. A secondary control system assures the parallelism of the linear motions of the bending apron.

7 Claims, 6 Drawing Figures

BENDING MACHINE

FIELD OF THE INVENTION

The invention relates to machinery for bending metal plates. More particularly, the invention relates to a pedestal-type bending machine having a rotatable apron and a plate-clamping mechanism and wherein the front edge of the rotatable apron forms the bend imparted to the metal plate.

BACKGROUND OF THE INVENTION

In order to bend metal plates, there are known in the art machines which include a horizontal table supported by two vertical posts and provided with a clamping mechanism which can be pressed on the top surface of a metal plate lying on the horizontal table. The shape of the front edge of the horizontal table corresponds to the shape of the bend imparted to the metal plate. In order to perform the bending operation and force the metal plate around the front edge of the horizontal table, there is provided a rotatable apron mounted on two pivoting arms which rotate in coaxial spindles. In these known bending machines, the spindle axis must coincide with the curvature axis of the bend imparted to the metal plate.

It will be appreciated that the relative positions of the table, of the plate clamping mechanism and of the spindles around which the apron rotates must all be properly determined on the basis of the thickness of the plate to be bent and the radius of curvature of the bend imparted to the plate. In some machines, accommodations for various thicknesses can be made by moving only the horizontal table which requires a relatively complex mechanical system and the mobility tends to reduce the overall rigidity of the table and the side posts.

In still other known machines, only the spindles are movable vertically within the housing and this movement also requires a complex mechanism which, however, normally does not diminish the overall rigidity of the table-side posts assembly.

In both cases however, adjustments must be made whenever plates of different thicknesses are to be bent or when the radius of curvatuve to be imparted to the plates is changed.

SUMMARY OF THE INVENTION

It is a principal object of the present invention to provide a bending machine for metal plates in which the aforementioned disadvantages are overcome. It is a second principal object of the invention to provide a bending machine for metal plates which adjusts the relative position of the apron with respect to the horizontal table automatically as a function of the thickness of the metal plate to be bent and of the curvature of the bend. Still another object of the invention is to provide a bending machine in which the relative position of the bending apron is changed automatically during the bending operation, permitting the production of bends having non-circular cross-sectional profiles.

These and other objects are attained according to the invention by providing means permitting transverse movement of the bending apron within its support arm, thereby permitting the front edge of the bending apron to move with respect to the horizontal table. The invention further provides control means for controlling the degree of displacement of the apron as a function of the bending profile desired and also depending on the degree of progress of the ongoing bending operation. In a first exemplary embodiment of the invention, each of the ends of the apron is fixedly attached to a carrier while a lead screw moves the carrier up and down within the support arm. Both lead screws are coupled to an electric drive motor and means are provided for insuring the synchronization of the relative displacements of the two apron carriers. For example, it may be advantageous to provide a single motor whose shaft is coupled to both lead screws. It is especially advantageous if this motor is of the "torque" type. With such a motor, the operator may define the resistant torque provided by the motor by a judicious choice of the supply current for the motor and thus may determine the pressure exerted by the apron on the plate to be bent. This pressure depends on the characteristics of the plate and on its thickness as well as on the shape of the desired bend. Advantageously, the torque motor may be supported on a crossbar which couples the two free ends of the support arms of the apron while a pair of 90° gear box transmissions transmits the rotation of the motor shaft to the lead screws.

In another embodiment of the invention, the means for moving the apron along its support arms are two jacks, each of which is located in one of the support arms. The body of the jack or the extending piston may be connected to the support arm while the other of the two members is coupled to the bending apron. Adjustable hydraulic controls are provided for supplying pressurized hydraulic fluid to the jacks so as to move the apron as a function of the desired bending profile as well as in order to insure the perfect parallelism of the displacement of the two ends of the bending apron. In a relatively simple embodiment of the invention, one of the hydraulic jacks acts as a master jack while the other takes the role of a slave jack. There is also provided a pressure limiting mechanism which determines the pressure exerted by the apron on the metal plate. A differential position detector controls a servo valve that in turn supplies the correct supply to the master jack so as to assure parallelism of the movable apron.

In a variant of this embodiment, the two jacks are both coupled to a master servo valve which is controlled by a differential position detector. Furthermore, a second differential position detector is coupled to a sensor affixed to the apron which follows a template that is representative of the bending profile to be imparted to the plate. The second differential detector is also coupled to the servo control valves for the hydraulic jack so as to control the displacement thereof as a function of the shape of the template.

The invention may be understood more clearly in the detailed description thereof which follows below and which relates to the illustrations in the accompanying drawing.

DETAILED DESCRIPTION OF THE INVENTION

Figure 1:
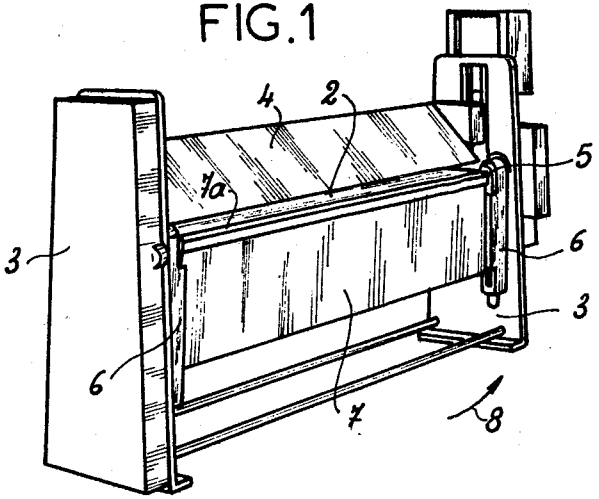
FIG. 1 is a perspective view of the bending machine according to the invention.

As best seen in FIG. 1, the bending machine according to the invention is of the type which includes a horizontal support table 2 which is itself mounted on two vertical mounting posts 3 which are part of a frame that also supports a movable plate clamping mechanism 4 that is capable of vertical motions above the horizontal table 2. The two mounting posts 3 also support two spindle journals 5 which permit the pivotal motion of two support arms 6 that hold and support a bending apron 7 of the bending machine. The above-described bending machine functions as follows: When a metal plate to be bent (not shown) is placed on the horizontal table 2 in such a way that the portion thereof extending beyond the intended bending line protrudes beyond the edge of the table, and the bending line lies directly above the edge of the apron 7, the plate clamping mechanism 4 is lowered in such a way as to apply a pressure on the plate and immobilize it with respect to the horizontal table 2. The front edge of the plate clamping mechanism 4 determines the angle and the curvature of the bend imparted to the plate after the arms 6 have pivoted in the sense of the arrow 8. During this pivoting motion, the upper edge 7*a* of the apron 7 also pivots from its initial horizontal position and takes with it that part of the plate which extends from the clamping mechanism 4.

If it is desired to impart to the plate a bend of relatively large radius of curvature, it is possible to place a cylinder having the desired radius between the plate and the clamping mechanism 4.

According to a principal feature of the present invention, the apron 7 is so mounted in its support arms 6 as to be able to glide therein along the extent of the support arms, i.e., essentially in a direction parallel to the plane defined by the apron. During this motion, the distance between its upper edge 7*a* to the common axis of the spindles 5 around which the arms 6 rotate varies. The invention provides a mechanism for controlling this variation during the pivotal motion of the arms 6 and as a function of the desired bending profile. These displacements of the apron are made possible by providing each of its lateral extremities with a groove 7*b* which engages and glides on a rib 9 affixed in the support arms 6 and which acts as a rail. In order to reduce frictional forces without diminishing the precision of movement, the side walls of the groove 7*b* are equipped with needle bearings.

Figure 4:
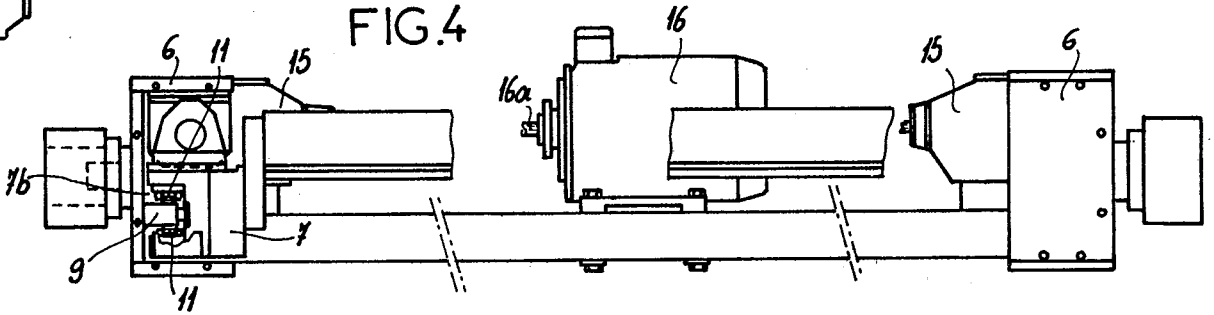
FIG. 4 is a top view of the apparatus illustrated in FIG. 2.
Figure 3:
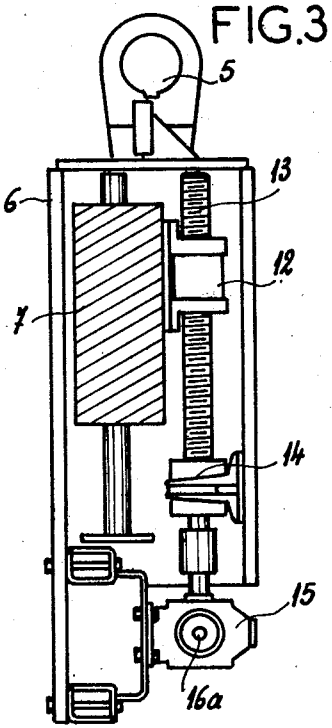
FIG. 3 is a sectional view along the lines 3—3 of FIG. 2.
Figure 2:
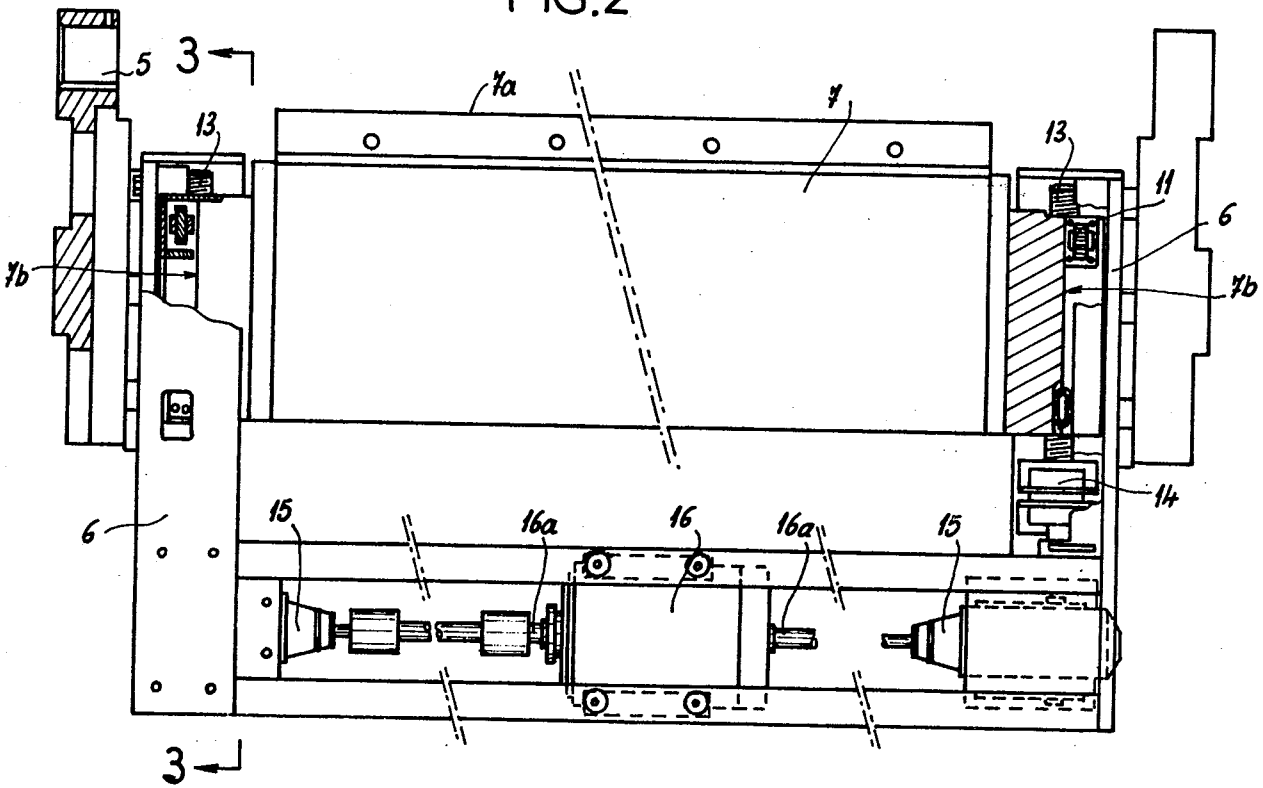
FIG. 2 is a front elevational view of one embodiment of the invention.

In a first embodiment of the bending machine according to the invention, as illustrated in FIGS. 2–4, each lateral end of the apron 7 is fixedly attached to a carrier 12 that moves by means of internal threads on a threaded lead screw 13 which is rotatably mounted in the support arms 6 by a support bearing 14. It will be appreciated that the rotation of the lead screws 13 provides the linear displacement of the apron 7 along the support arms 6. As best seen in FIG. 2, each lead screw 13 is rotatably coupled via a 90° gear transmission 15, not shown in detail, to one of the ends of the rotating shaft 16*a* of an electric motor 16 which is preferably of the "torque" type.

The torque of the motor 16 is determined by its supply current and it is thus possible by suitable choice of the supply current to control the pressure exerted by the edge 7*a* of the apron 7 on the plate to be bent.

If the resistance offered by the plate causes a change of this torque, the torque motor 16 can retrieve the apron 7 while, conversely, if the resistance offered by the plate to the apron 7 diminishes, the torque motor can advance the apron until an equilibrium of torques is obtained between the torque motor on the one hand and the resisting torque on the other hand.

The bending machine is thus able to function entirely automatically without any auxiliary control steps to be taken once the bending operation has begun. Furthermore, it is not necessary for the curvature of the bend to define a cylinder inasmuch as the radius of the trajectory of the edge 7*a* of the apron 7 may vary during the rotation of the apron.

Figure 5:
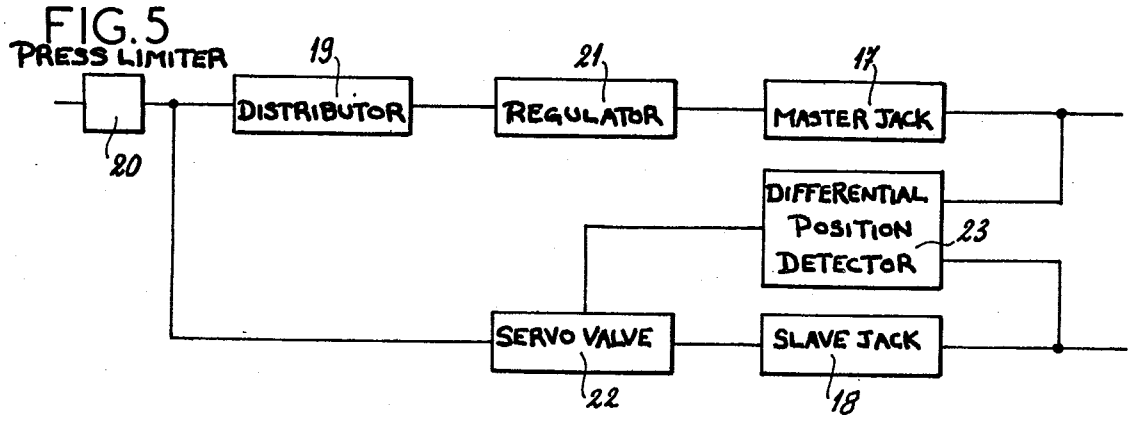
FIG. 5 is a schematic illustration of a second embodiment for the displacement mechanism of the apron.
Figure 6:
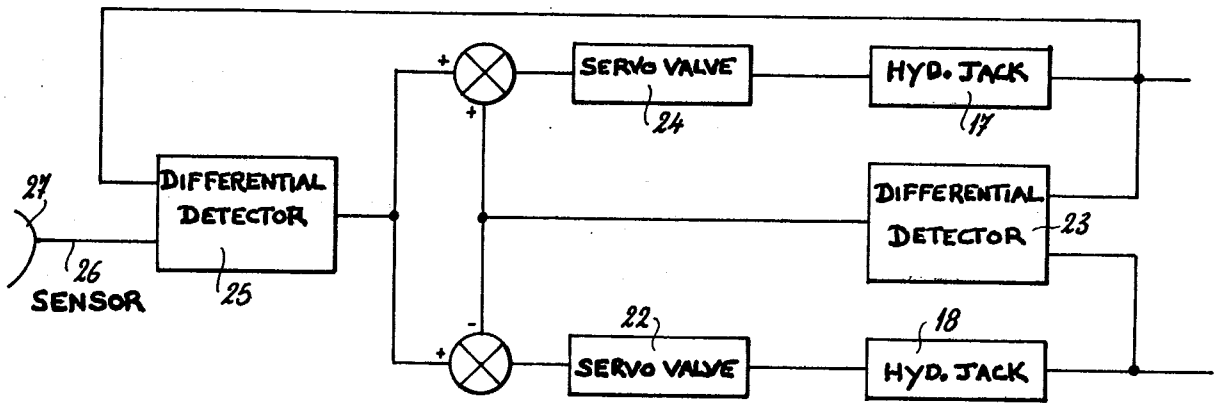
FIG. 6 is a schematic illustration of a variant of the mechanism of FIG. 5.

FIGS. 5 and 6 are block diagrams illustrating variants of the invention. In the example illustrated schematically in FIG. 5, the lead screws 13 are replaced by hydraulic jacks 17 and 18. The jack 17 acts as a master jack which is supplied with hydraulic fluid by a distributor 19 acting through a flow regulator 21 and the pressure exerted by the apron on the plate to be bent is determined by the principal pressure limiter of the machine. The jack 18 acts as a slave jack and is supplied with hydraulic fluid through a servo valve 22 whose opening motions are controlled by a differential position detector 23. As a result, the pressure limiter 20 determines the pressure exerted by the apron 7 on the plate to be bent and thus defines the threshold of pressure beyond which the apron will recede and up to which it will be caused to advance. It is the purpose of the differential detector 23 to correct any possible errors of parallelism in the motions of the apron 7.

In the second example illustrated in FIG. 6, the two hydraulic jacks 17 and 18 are supplied by respective hydraulic servo valves 24 and 22 whose opening motions are controlled by the differential detector 23. As in the previous example, it is the only purpose of the differential detector 23 to measure and correct any errors of parallelism in the displacement of the apron 7. However, by contrast to the foregoing example, a provision is now made for subjecting the displacements of the apron 7 to regulation as a function of the desired bending profile. This is accomplished by the provision of a second differential position detector 25 which acts in association with the first detector 23 to control the openings and closures of the servo valves 22 and 24. The second differential detector 25 receives control signals from a tactile sensor 26 which is suitably disposed on the machine to follow the contours of a template 27 while the support arms of the apron 7 are rotating. The template 27 may suitably be attached to one of the support posts 3 of the frame of the machine. During the rotation of the apron, the position detector 25 supplies control signals to the jacks 17 and 18 via the respective servo valves 24 and 22 so as to displace the jacks in the desired direction. The motion of the apron 7 along the support arms 6 changes the output signals of the differential detector 25 attached to the apron 7. Accordingly, the detector 25 continues to generate control signals as a function of the distance between points on the template 27 and the apron 7.

As indicated above, the differential detector 23 supplies control signals related to the difference of the respective positions of the jacks 17 and 18 with the purpose of eliminating any such difference due, for example, to small mismatches in the hydraulic supply circuits of the jacks 17 and 18.

It should be noted that it is possible to replace the master jack and one of the servo control valves of the slave jack in the embodiment of FIG. 5 by, for example, a double servo valve control system of the type described, for example, in the French patent No. 73 01503.

Furthermore, it will be appreciated that the foregoing embodiments and variants are provided entirely by way of non-limiting examples, and that other embodiments and variants thereof are possible without departing from the spirit and scope of the invention.

I claim:

1. A bending machine for bending a metal plate and the like, said bending machine including a frame having two lateral support posts, a horizontal table for supporting the plate to be bent mounted between said support posts, a plate clamping mechanism attached to said frame for clamping and immobilizing a plate to be bent on said horizontal support table, the front edge of said plate clamping mechanism serving to define the radius of curvature of the bend imparted to said metal plate, two support arms, each of which is mounted pivotably on one of said support posts, said support arms holding between them a bending apron, and wherein the improvement comprises:

means for providing linear motion to said bending apron within said support arms;

first control means for controlling the direction and extent of the linear motion of said bending apron during the pivotal motion thereof in the course of bending said metal plate; and second control means for synchronizing and equalizing the linear motion of opposite transverse ends of said bending apron;

wherein said means for providing linear motion to said bending apron includes a lead screw mounted rotatably within each of said support arms, an internally threaded carrier moving on said lead screw and attached fixedly to one lateral extremity of said apron, and an electric motor for providing rotary motion to said lead screws; whereby, when said motor is turning, the lead screws are caused to rotate in synchronism, thereby providing axial motions to said carriers and thereby supplying linear motion to said bending apron while said second control means assure the synchronization of linear displacement of said carriers.

2. A bending machine as defined by claim 1, wherein said electric motor is a single electric motor coupled to both of said lead screws to provide rotation thereto.

3. A bending machine as defined by claim 2, wherein said electric motor is a "torque" motor.

4. A bending machine as defined by claims 2 or 3, further comprising a crossbar attached to the two ends of said support arms remote from said pivots, said electric motor being mounted on said crossbar and means being provided for imparting rotary motion to said lead screws from opposite ends of said motor shaft by gear boxes which provide a change in the axis of rotation.

5. A bending machine for bending a metal plate and the like, said bending machine including a frame having two lateral support posts, a horizontal table for supporting the plate to be bent mounted between said support posts, a plate clamping mechanism attached to said frame for clamping and immobilizing a plate to be bent on said horizontal support table, the front edge of said plate clamping mechanism serving to define the radius of curvature of the bend imparted to said metal plate, two support arms, each of which is mounted pivotably on one of said support posts, said support arms holding between them a bending apron, and wherein the improvement comprises:

means for providing linear motion to said bending apron within said support arms;

first control means for controlling the direction and extent of the linear motion of said bending apron during the pivotal motion thereof in the course of bending said metal plate; and second control means for synchronizing and equalizing the linear motion of opposite transverse ends of said bending apron;

wherein said means for providing linear motion to the bending apron within said support arms are two hydraulic jacks, each of which is placed within one of said support arms, each of jacks including two relatively movable parts, one of said parts being supported by said support arms and the other of said parts being coupled to one lateral extremity of said apron, and wherein the improvement further comprises means for supplying pressurized hydraulic fluid to said hydraulic jacks under the control of said first control means to control the direction and extent of the motion of said bending apron and further under the control of said second control means for synchronizing and equalizing the linear motion thereof.

6. A bending machine as defined by claim 5, wherein one of said jacks is connected as a master jack to said first control means, said first control means including a pressure limiter for limiting the pressure applied by said apron on said metal plate and said second control means including a differential position detector for controlling the motions of said second jack in order to provide the parallelism of said bending apron during its linear motions.

7. A bending machine as defined by claim 5, wherein said first control means includes a differential position detector having a sensor for following the contours of a profile template defining the radius of curvature to be imparted to said metal plate, and wherein said second control means includes a second differential detector for insuring the parallelism of opposite transverse ends of said bending apron during its linear motions; whereby said sensor follows the contour of said template during the bending operation and provides signals for servo control valves which cause the displacement of said hydraulic jack as a function of the contour of said template.

* * * * *